US010458726B2

(12) United States Patent
Nguyen et al.

(10) Patent No.: US 10,458,726 B2
(45) Date of Patent: Oct. 29, 2019

(54) ATTACHMENT DEVICE FOR HEAT EXCHANGER

(71) Applicant: Valeo Systemes Thermiques, Le Mesnil Saint Denis (FR)

(72) Inventors: Dinh-Luyen Nguyen, Le Mesnil Saint-Denis (FR); Karim Arab, Le Mesnil Saint-Denis (FR); Nathalie Girard, Le Mesnil Saint-Denis (FR); Fernando Pereira, Le Mesnil Saint-Denis (FR); Daniel Pereira, Le Mesnil Saint-Denis (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 233 days.

(21) Appl. No.: 15/526,043

(22) PCT Filed: Nov. 13, 2015

(86) PCT No.: PCT/EP2015/076621
§ 371 (c)(1),
(2) Date: Aug. 16, 2017

(87) PCT Pub. No.: WO2016/075320
PCT Pub. Date: May 19, 2016

(65) Prior Publication Data

US 2017/0356699 A1 Dec. 14, 2017

(30) Foreign Application Priority Data

Nov. 14, 2014 (FR) ..... 14 60990

(51) Int. Cl.
*F28F 9/26* (2006.01)
*F28F 9/00* (2006.01)
(Continued)

(52) U.S. Cl.
CPC ..... *F28F 9/262* (2013.01); *F25B 39/00* (2013.01); *F28F 9/002* (2013.01); *F25B 39/04* (2013.01);
(Continued)

(58) Field of Classification Search
CPC .... F28F 9/262; F28F 9/002; F28F 9/18; F28F 2220/00; F25B 39/00; F25B 39/04; F25B 2339/0442; F28D 2021/0084
(Continued)

(56) References Cited

U.S. PATENT DOCUMENTS 5,046,544 A * 9/1991 Coluccio ..... B60J 5/14 160/189
5,069,275 A * 12/1991 Suzuki ..... B60K 11/04 165/149
(Continued)

FOREIGN PATENT DOCUMENTS

DE 10338526 A1 3/2004
EP 1517108 A2 3/2005
(Continued)

OTHER PUBLICATIONS

International Search Report issued in corresponding application No. PCT/EP2015/076621 dated Feb. 10, 2016 (6 pages).
(Continued)

*Primary Examiner* — Justin M Jonaitis
(74) *Attorney, Agent, or Firm* — Osha Liang LLP

(57) ABSTRACT

The invention concerns an attachment device (3) for a heat exchanger (2) comprising a core (23) for exchanging heat between a first fluid and a second fluid, said core (23) being provided with collectors (21) for the first fluid, said exchanger (2) comprising a cylinder (25), said cylinder (25) and one of said collectors (21) allowing the passage of said first fluid from one to the other, said attachment device (3)
(Continued)

comprising a body, which is set up in order to close said cylinder (25), and an extension which allows the core (23) to be secured to a holder (4).

The invention also concerns a cylinder (25) which comprises such an attachment device (3), a heat exchanger (2) which comprises such a cylinder (25) and a heat exchanging module which comprises such a heat exchanger (2).

9 Claims, 2 Drawing Sheets

(51) Int. Cl.

| | |
|---|---|
| ***F25B 39/00*** | (2006.01) |
| ***F28D 21/00*** | (2006.01) |
| ***F25B 39/04*** | (2006.01) |
| ***F28F 9/18*** | (2006.01) |

(52) U.S. Cl.
CPC ..... *F25B 2339/0442* (2013.01); *F28F 9/18* (2013.01); *F28F 2220/00* (2013.01)

(58) Field of Classification Search
USPC ..... 165/67, 68, 41, 42, 44
See application file for complete search history.

(56) References Cited

U.S. PATENT DOCUMENTS

| | | | | |
|---|---|---|---|---|
| 5,127,466 | A * | 7/1992 | Ando | F28F 9/002 165/153 |
| 5,205,349 | A * | 4/1993 | Nagao | B60H 1/00328 165/153 |
| 5,355,941 | A | 10/1994 | Blankenberger et al. | |
| 5,529,116 | A * | 6/1996 | Sasaki | F28D 1/0417 123/41.51 |
| 2010/0044007 | A1 * | 2/2010 | Sensui | B60H 1/00535 165/67 |
| 2010/0078149 | A1 * | 4/2010 | Yoshimitsu | B60K 11/04 165/67 |

FOREIGN PATENT DOCUMENTS

| | | | | |
|---|---|---|---|---|
| EP | 1686334 | A2 | 8/2006 | |
| FR | 3000190 | A1 | 6/2014 | |
| JP | 3880097 | B2 | 2/2007 | |
| WO | WO-2016075320 | A1 * | 5/2016 | F28F 9/002 |

OTHER PUBLICATIONS

Written Opinion of the International Searching Authority issued in corresponding application No. PCT/EP2015/076621 dated Feb. 10, 2016 (5 pages).

* cited by examiner

ATTACHMENT DEVICE FOR HEAT EXCHANGER

BACKGROUND

The invention relates to the area of heat exchangers and concerns, in particular, an associated attachment system. It can be used, notably, in the field of motor vehicles.

SUMMARY

Heat exchangers which comprise a heat exchanging core, two collectors and a cylinder which is associated with one of the collectors are known. For their installation, said heat exchangers are provided with attachment devices which allow the heat exchanger to be secured to a holder. Flanges, in general four per heat exchanger, that is to say one at each corner of the exchanger, which have been fixed directly between the heat exchanging cores and the holder, have been known up to now. Furthermore, the cylinder has comprised several parts which serve for defining an interior volume.

One of the problems encountered with said type of installation is that each attachment element constitutes a cost, a production step and an assembly step. Furthermore, each attachment element occupies an important space in the installation environment which is often already particularly congested.

One aim of the invention is to improve said situation. The invention thus concerns an attachment device for the heat exchanger which comprises a core for exchanging heat between a first fluid and a second fluid, said core being provided with at least one collector for the first fluid, said exchanger comprising a cylinder, said attachment device comprising a body, which is set up in order to close said cylinder, and an extension which allows the core to be connected to a holder.

In so doing, one of the parts of the cylinder of the heat exchanger is used to provide an attachment function between said exchanger and a holder which can be, for example, a radiator, a fan-motor assembly or an element of the vehicle chassis. In this way, the element can do without at least one of the four flanges used up to now.

It must be noted that said cylinder and one of said at least one collector allow said first fluid to pass from one to the other.

According to different embodiments, which can be taken together or separately:

said body and said extension are formed from a material, said material is aluminum or an aluminum alloy, said body is suitable for serving as a cap for said cylinder, said extension is a fixing bracket, said fixing bracket has a cutout which is suitable for securing the core to the holder, said fixing bracket is configured to allow the exchanger to be attached to the holder by means of screwing, crimping, welding, clipping, etc.

said body is configured to allow said device to be attached to said cylinder by means of screwing, crimping, brazing or bonding.

The invention also concerns a cylinder which comprises an attachment device such as is described above. According to different embodiments, which can be taken together or separately:

said cylinder extends along a main direction of longitudinal extension, the so-called main direction, said cylinder having a first end, the so-called bottom end, and a second end, the so-called top end, said bottom end being opposite said top end along the main direction, said attachment device is situated in the vicinity of said bottom end, said attachment device is situated in the vicinity of said top end.

The invention also concerns a heat exchanger which comprises a cylinder such as described above. According to different embodiments, which can be taken together or separately:

said exchanger further comprises flanges and has a form with corners, said flanges being situated at said corners, one of said corners, which is situated in the vicinity of the attachment device, is free of any flange, said exchanger is a condenser.

The invention also concerns a heat exchanging module which comprises an exchanger such as described above. According to different embodiments, which can be taken together or separately:

the holder of said first exchanger is a second heat exchanger of said module, said second exchanger is a radiator, said module is configured so as to be installed in an engine compartment of a vehicle, notably of a motor vehicle.

BRIEF DESCRIPTION OF THE DRAWINGS

The invention will be better understood, and other aims, details, characteristics and advantages of the same will appear more clearly during the detailed explanatory description which follows, of at least one embodiment of the invention which is given by way of example purely as an illustration and is in no way limiting, with reference to the accompanying schematic drawings.

DETAILED DESCRIPTION

Figure 1:
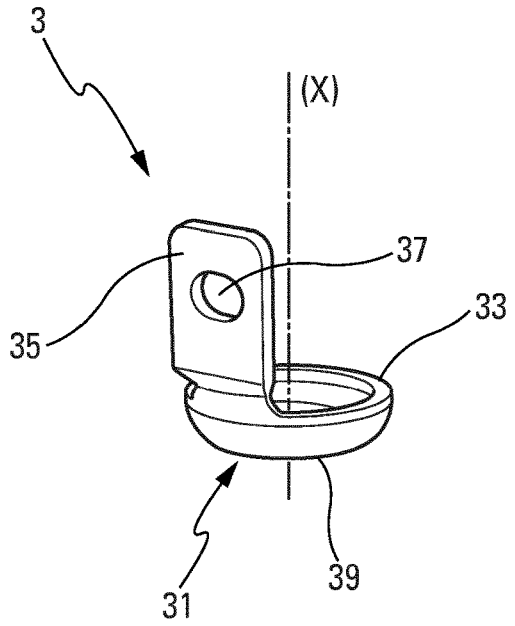
FIG. 1 is a perspective view of an embodiment of an attachment device according to the invention.
Figure 2:
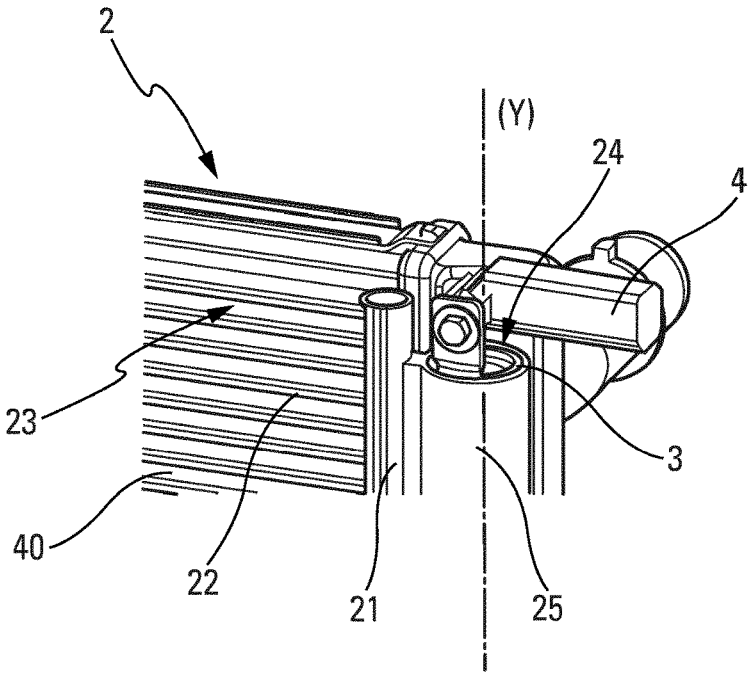
FIG. 2 is a part view in perspective of an embodiment of a heat exchanging module according to the invention which here is illustrated upside down.

As shown in FIGS. 1 and 2, the invention concerns an attachment device 3 for a heat exchanger 2, notably for a vehicle, in particular for a motor vehicle. Said attachment device 3 is advantageously intended to be used in an engine compartment of such a vehicle.

Said heat exchanger 2 allows a thermal exchange between a first fluid which circulates inside said heat exchanger 2 and a second fluid which circulates through the same. In an advantageous manner, said exchanger 2 is a condenser and the first fluid is a refrigerant fluid which is present in the heat exchanger 2 in different liquid and/or gaseous phases. In the embodiment shown in FIG. 2, the second fluid is an air flow, notably an ambient air flow which beforehand has passed through a vehicle radiator grille.

Said heat exchanger 2 comprises a core 23 for exchanging heat between said first fluid and said second fluid. Said core 23 comprises, for example, a set of tubes 22, which are preferably parallel to one another, inside which the first fluid circulates.

Said core 23 is provided, moreover, with collectors 21 for the first fluid. Collectors 21 are to be understood as elements which have a tubular form allowing said first fluid to circulate inside the tubes 22 of the core 23. To do this, said tubes 22 open out at each of their ends into one of said collectors 21. In other words, said core 23 is provided with two collectors 21 which are situated on both sides of the tubes 22. One of the collectors 21 can serve as inlet collector and the other as outlet collector of the first fluid. As an alternative to this, the same collector 21 can serve for both the inlet and the outlet of the first fluid. Said collectors 21 can be provided with internal partitions which allow said first fluid to be circulated in several stages in said core 23. The bottom part of one of said collectors 21 can be seen in FIG. 2, in view of the reversed orientation of said figure.

Said core 23 can furthermore comprise dividers 40 which are situated between said tubes 22 in order to increase the surface for exchange with the second fluid.

Said heat exchanger 2 additionally comprises a cylinder 25. Said cylinder 25 and one of said collectors 21, the one that can be seen in FIG. 2, are arranged and configured to allow said first fluid to pass between one and the other.

Said cylinder 25 is, for example, a vessel with an elongated cylindrical form. It is designed to separate the different liquid and/or gaseous phases of said first fluid. Said cylinder 25 optimizes the operation of the air conditioning loop in which the heat exchanger 2 is intended to be used to ensure that purely a liquid phase of said first fluid circulates downstream, the possible gaseous phase remaining blocked in the cylinder 25. Said cylinder 25 can comprise a filter and/or a desiccator.

The cylinder 25 is made integral with the core 23, for example by attaching it by means of brazing or screwing to one of the collectors 21 of the heat exchanger 2 so that the refrigerant fluid is able to circulate between the cylinder 25 and one of the collectors 21 of said heat exchanger 2.

Said cylinder 25 is configured so as to be closed by said attachment device 3 according to the invention. Furthermore, the attachment device 3 allows said core 23 to be secured to a holder 4. In the embodiment shown here, said holder 4 is a second heat exchanger, notably a radiator, and the condenser 2 is subject to a collector of said radiator 4.

Said attachment device 3 comprises a body 31 and an extension 35, both advantageously formed from a material. In other words, the body 31 and the extension 35 are in one piece.

In particular, said body 31 comprises a base 39 and a raised edge 33. Said base 39 is a disk of material which here has a substantially planar, circular form. The edge of said base 39 is slightly rounded so as to facilitate its insertion into a side wall of said cylinder 25. In other words, said base 39 is a plate, which is extended in a rounded manner by said raised edge 33. The raised edge 33 is designed, preferably, in the form of a ring which is intended to be adapted to the form of a cross section of an internal volume of said cylinder 25. Said raised edge 33 is oriented here in a manner which is substantially orthogonal to said base 39.

In other words, the body 31, thus constituted by the base 39 and the raised edge 33, is designed to operate as a cap for said cylinder 25. Put another way, said body 31 closes said cylinder 25.

It must be noted that the raised edge 33 and said base 39 are advantageously formed from a material. Here, said body 31 is intended to be brazed to the side wall of the cylinder 25 by means of said raised edge 33. As an alternative to this, the body 31 can be secured to said cylinder 25 in a non-definitive manner, such that it is still possible for a user to open the cylinder 25, for example for a maintenance operation. Said securement between the body 31 and the cylinder 25 can therefore be by means of screwing.

Said extension 35 is here formed from said raised edge 33, which it extends in the same direction. It must be noted that said body 31 and said extension 35 can be two parts that were initially separate that have been assembled together. The assembly made up by the body 31 and by the extension 35 is advantageously an assembly that is sufficiently rigid so that it is capable of resisting different stresses that it may encounter in an engine compartment whilst maintaining its general form and its function of keeping the cylinder sealed.

Said extension 35 is, for example, a fixing bracket and will be designated as such below. The fixing bracket 35 is, preferably, a plate, notably a metal plate which is rectangular in form. It has, preferably, rounded edges and ends. Said fixing bracket 35 has a cutout 37 (also called a hole, hollow, cavity), which is notably oblong in form and allows the passage of an assembly means. A nut and screw assembly can be implemented, for example.

Said form 37 thus allows the fixing bracket 35 and the holder 4 to be secured. In another embodiment, said fixing bracket 35 can be fixed to the holder 4 by crimping, or also by welding. In the case of fixing by crimping or by welding, there is no need for the fixing bracket 35 to have a cutout 37.

The form of said fixing bracket 35 described here is not limiting. Other forms can be conceived in other embodiments. For example, the fixing bracket 35 can be curved.

The width of the fixing bracket 35 is reduced, for example, at the connection between said fixing bracket 35 and the raised edge 33. The elongated form of said fixing bracket 35 extends, for example, along a main direction which is parallel to an X axis, forming an axis of symmetry of the base 39, such that the plane defined by said fixing bracket 35 is perpendicular to said base 39.

In another embodiment, the fixing bracket 35 has a different orientation with respect to the body 31. For example, the fixing bracket 35 can form an angle of between 0 and 90 degrees inclusive with the base 39, this is so that it can be adapted to a particular arrangement of the engine compartment and/or of the holder 4.

The attachment device 3 can be designed in aluminum or in an aluminum alloy, as the remainder of the exchanger.

That being said, said cylinder 25 extends here along a main direction of longitudinal extension which is referenced by a Y axis, the so-called main direction Y, which is intended to be combined with the X axis of the attachment device 3.

Said cylinder 25 has a first end, the so-called bottom end 24, and a second end, the so-called top end 26, said bottom end 24 being opposite said top end 26 along the main direction. Said bottom end 24 is intended to be in contact with said liquid phase of the refrigerant fluid whilst said top end 26 is intended to be in contact with said gaseous phase of said refrigerant fluid.

Said attachment device 3 closes the cylinder 25 at the bottom end 24, which can be seen in FIG. 2 in the top part in view of the reversal of direction in said figure.

Said cylinder 25 advantageously comprises a base, which is shown in the bottom part and is provided with said attachment device 3, and a body, which is less thick and extends said base in an axial manner. The passage of fluid between the core 23 and the cylinder 25 can be effected at said base.

Figure 3:
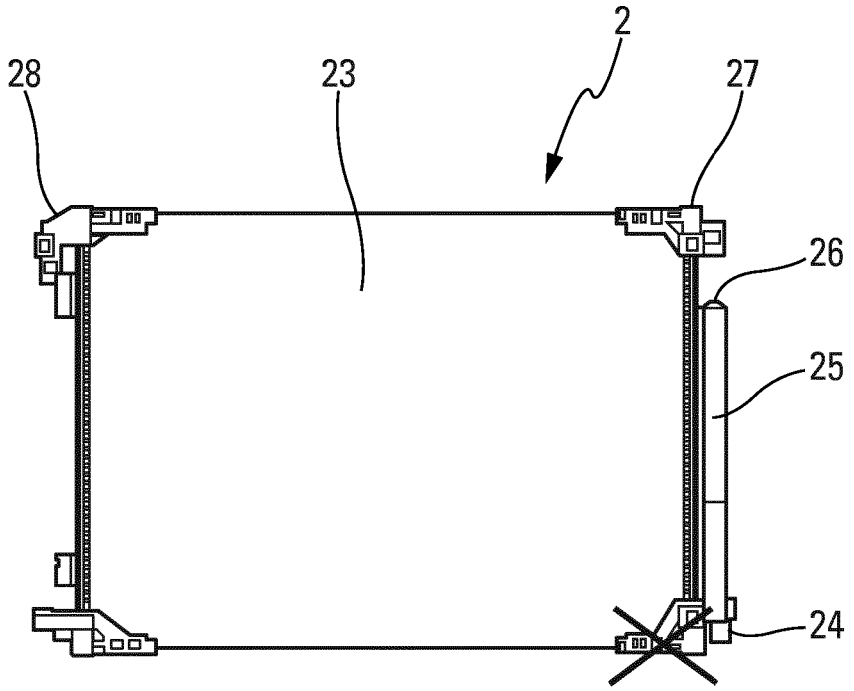
FIG. 3 is a front view showing an example of a heat exchanger, modified so as to receive said attachment device shown in FIG. 1.

Such as illustrated in FIG. 3, the exchanger according to the invention further comprises flanges 28 and has a form, which here is substantially rectangular, with corners 27, said flanges 28 being situated at the corners 27. As can be seen in FIG. 3, said exchanger 2 is usually provided with four flanges 28, that is to say one flange 28 at each of its corners 27. The present invention, thanks to said attachment device 3 and to its dual function of closing said cylinder 25 and of fastening it to said holder 4, obviates the need for the flange 28 situated closest to said attachment device 3, said flange 28 being signaled by a cross. In other words, said heat exchanger 2 in the present invention is characterized in that the corner 27, being situated in the vicinity of the attachment device 3, is free of any flange 28, here the bottom right-hand corner. Furthermore, the bottom right-hand corner includes crossed lines forming an "X" which represents that this corner 27 does not include a flange 28.

The invention also concerns a heat exchanging module, not shown here, for a vehicle, notably a motor vehicle, which comprises a heat exchanger 2 such as described above. Said heat exchanging module is intended to be integrated in the engine compartment of said vehicle. Said module can comprise the holder 4 of said exchanger 2 which here, as already said, is a second heat exchanger, in this case a radiator. Said radiator is configured to operate an exchange of heat between a heat transfer fluid and said flow of ambient air crossing the first exchanger 2 such that the unwanted thermal energy of the engine is transferred to said ambient air flow.

The invention claimed is:

1. An attachment device for securing a heat exchanger to a holder, the heat exchanger comprising a core for exchanging heat between a first fluid and a second fluid which comprises a hollow cylinder, said attachment device comprising:

an annular body that is configured to engage an inner wall of an opening located at a longitudinal end of the hollow cylinder, wherein the engagement of the annular body within the opening covers the opening in a cap-like manner; and an extension for securing the core to the holder, said extension projecting from a surface of the body.

2. The attachment device as claimed in claim 1, wherein said body and said extension are formed from a same material.

3. The attachment device as claimed in claim 1, wherein said extension is a fixing bracket.

4. The attachment device as claimed in claim 3, wherein said fixing bracket comprises a cutout for securing the core to the holder.

5. A heat exchanger to be secured to a holder comprising:

a core for exchanging heat between a first fluid and a second fluid, said core comprising at least one collector and a hollow cylinder;

an attachment device comprising:

an annular body that is configured to engage an inner wall of an opening located at a longitudinal end of the hollow cylinder, wherein the engagement of the annular body within the opening covers the opening in a cap-like manner; and an extension for securing the core to the holder, said extension projecting from a surface of the body.

6. The heat exchanger as claimed in claim 5, wherein the heat exchanger further comprises:

two or more corners, and

One or more flanges, said one or more flanges being situated on at least one of said two or more corners, Wherein one of said two or more corners is situated in the vicinity of the attachment device and is free of said one or more flanges.

7. The heat exchanger as claimed in claim 5 wherein:

said hollow cylinder extends in a main direction of longitudinal extension, said cylinder comprises a bottom end and a top end, said bottom end being opposite said top end along the main direction of longitudinal extension; and said attachment device engages the hollow cylinder at said bottom end.

8. A heat exchanging module comprising:

a heat exchanger as claimed in claim 5; and a holder.

9. The heat exchanging module as claimed in claim 8, wherein the holder is a second heat exchanger.

* * * * *